United States Patent [19]

Phillipp et al.

[11] 4,341,975

[45] Jul. 27, 1982

[54] JACKETED LAMP HAVING TRANSVERSELY MOUNTED ARC TUBE

[75] Inventors: Robert G. Phillipp, Parma, Ohio; Theodore S. Apple, Philadelphia, Pa.; Paul W. Ernest, Cleveland Hts., Ohio

[73] Assignee: General Electric Company, Schenectady, N.Y.

[21] Appl. No.: 158,932

[22] Filed: Jun. 12, 1980

[51] Int. Cl.[3] ..... H01J 61/30; H01J 61/36

[52] U.S. Cl. ..... 313/25; 313/324

[58] Field of Search ..... 313/25, 312, 324

[56] References Cited

U.S. PATENT DOCUMENTS

| | | | |
|---|---|---|---|
| 2,901,648 | 8/1959 | Linsday et al. | 313/25 |
| 2,904,710 | 9/1959 | Beeninga et al. | 313/25 |
| 3,621,317 | 11/1971 | Kerr | 313/25 |
| 3,858,078 | 12/1974 | Koury | 313/220 |
| 4,142,122 | 2/1979 | Koza | 313/25 X |

*Primary Examiner*—Palmer C. Demeo

*Attorney, Agent, or Firm*—Ernest W. Legree; Philip L. Schlamp; Fred Jacob

[57] ABSTRACT

Transverse mounting of the arc tube within the lamp jacket is effected through a mount featuring a hinged attachment of the arc tube between divergent support rods which serve also as electrical connectors to the electrodes. During manufacture the hinges permit the arc tube to be folded in line with one support rod attached at the stem leading and the other trailing for passage through the neck, and then allow the arc tube to be transversely erected in the jacket after which the other rod is attached at the stem. Erection of the arc tube simultaneously causes leaf springs to engage the sides of the bulb and centralize the arc tube in its transverse attitude.

9 Claims, 3 Drawing Figures

JACKETED LAMP HAVING TRANSVERSELY MOUNTED ARC TUBE

The invention relates to a high intensity discharge lamp comprising an arc tube transversely mounted in an outer envelope or glass jacket, and is more particularly concerned with the arrangement and technique for effecting the transverse mounting.

BACKGROUND OF THE INVENTION

The invention is particularly useful with metal halide arc discharge lamps used for general illumination which ordinarily comprise a generally cylindrical arc tube of quartz or fused silica having electrodes at each end. The arc tube contains a fill of mercury, metal halide and an inert gas for starting purposes. During normal operation, the pressure within the arc tube is above one atmosphere and its temperature is in excess of 600° C. Metal halide lamps have largely replaced the high pressure mercury vapor lamp because they are almost twice as efficient in converting electrical energy into light and yield a whiter light of superior color rendition.

Metal halide lamps, in common with most high intensity discharge lamps used for general illumination, are provided with an outer envelope or jacket made of glass which encloses the arc tube. The jacket which is either evacuated or filled with an inactive gas keeps air away from the seals and metal inleads which otherwise would oxidize at the operating temperature. It gives mechanical protection, and serves as a heat conservator and as a short wave ultraviolet filter. The jacket generally comprises a bulbous or ellipsoidal main portion which is extended at one end into a tubular neck portion to which is attached a screw type base for accommodating the lamp in a standard socket. The common practice has been to mount the arc tube axially within the jacket and this of course facilitates passing the arc tube mount or frame through the neck in lamp manufacture.

Vertical operation of the arc tube is the preferred mode resulting in higher efficiency and longer life. The discharge in a metal halide lamp is a constricted arc which extends along the axis or midline of the arc tube so long as the arc tube is vertical. If the arc tube is inclined out of the vertical, and all the more so if it is made horizontal, internal convection currents affect the discharge and displace it from the axis. In a horizontal arc tube, the discharge is bowed up and may even contact the upper wall. This means that port of the arc tube where the discharge is in close proximity to the upper wall is overheated while the lower extremities are underheated. The partial overheating is responsible for poorer maintenance and shorter life, while the partial underheating reduces the vapor pressure of the metal halides and causes lower efficacy and poorer color rendition. The end result is that efficacy and life are reduced from 10 to 15% when a conventional metal halide lamp is operated with the arc tube horizontal instead of vertical.

While vertical operation is most common, there are many installations wherein considerations of space or convenience and economy require that the outer envelope of the lamp be mounted horizontally. In recent years, primarily as a result of improvements in color rendition, metal halide lamps have found increasing use indoors and in applications where the ceiling height is limited. Fixtures for such applications mount the outer envelope horizontally in order to save space. This has increased the demand for metal halide lamps able to operate without reduction in efficacy or life when the outer envelope is horizontal.

Mounting the arc tube transversely to the axis of jacket is difficult because the arc tube is longer than the diameter of the neck. The disadvantages of horizontal operation of the arc tube may be alleviated to some extent by bowing or arching the arc tube as indicated for instance in U.S. Pat. No. 3,858,078 - Koury. However bowed arc tubes are comparatively expensive to manufacture and offer at best an expensive solution to the problem.

SUMMARY OF THE INVENTION

The objects of the invention are to provide a jacketed high intensity discharge lamp and specifically a metal halide lamp in which the arc tube is mounted transversely to the axis whereby the arc tube may be vertical when the lamp's jacket is horizontal together with a convenient method of manufacture. A mounting arrangement is sought which is reliable and economical to manufacture.

In accordance with our invention, transverse mounting of the arc tube in the bulb of a jacketed lamp is effected through a mount featuring a hinged attachment of the arc tube between divergent support rods which serve also as electrical connectors to the electrodes. During manufacture the hinges permit the arc tube to be folded in line with one support rod leading and the other trailing for passage through the neck, and then allow the arc tube to be transversely erected in the bulb. In a preferred construction a long support rod attached to one inlead at the stem leads during insertion; it extends the full length of the jacket and becomes anchored at the dome end. A short support rod trails and is advanced to erect the arc tube within the bulb after it has passed through the neck. Advancement of the short rod simultaneously causes leaf springs to engage the sides of the bulb to centralize the arc tube in its transverse attitude. The short rod is then welded to the other inlead, suitably by welding electrodes which are inserted through the neck and overreach the stem to engage rod and inlead. Thereafter manufacture is completed in a conventional way.

DETAILED DESCRIPTION

Figure 1:
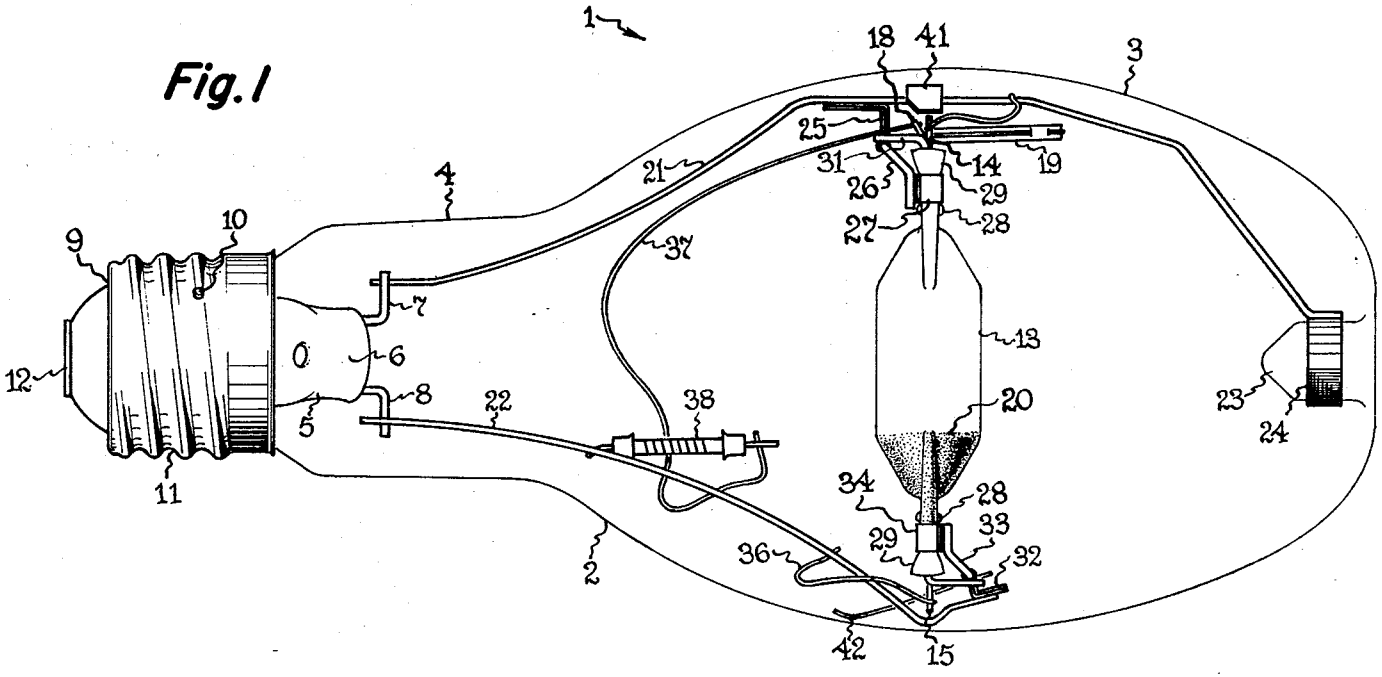
FIG. 1 illustrates a complete jacketed metal halide lamp with transversely mounted arc tube embodying the invention.

Referring to FIG. 1, lamp 1 illustrated therein comprises an outer envelope or jacket 2 of glass comprising a bulb portion 3 and a reduced diameter tubular neck portion 4. In the end of the neck is sealed a re-entrant stem 5 having a press 6 through which extend stiff lead-in wires 7,8. To the outer end of the neck is fastened the usual screw base 9, the lead-in wires 7,8 being connected respectively to the threaded shell 11 and center contact 12 thereof. A locating pin 10 may be provided on shell 11 which strikes a stop in the socket in which the lamp is accommodated after the lamp has been screwed in almost home. This prevents further rotation of the lamp so that a uniform orientation is achieved in all such sockets.

Arc tube 3 is made of quartz or fused silica and contains mercury, metal halides such as NaI, $ScI_3$ and $ThI_4$ and an inert gas such as argon at a low pressure to facilitate starting. The arc discharge takes place between main electrodes (not shown) supported in opposite ends of the arc tube by inleads 14, 15 which include foliated portions hermetically sealed through conventional wide pinch seals 16, 17. There is also an auxiliary starting electrode supported in the upper end of the arc tube by inlead 18 to which a bimetal switch 19 is attached. The switch has a portion which flexes out after the lamp has warmed to temperature and engages inlead 14. The short circuit between the auxiliary and the adjacent main electrode eliminates any potential difference between them which could cause devitrification in the quartz between their inleads. There is a white heat-reflecting coating 20 on the lower end of the arc tube.

In accordance with the invention, arc tube 13 is transversely supported in bulbous portion 3 of the jacket through a mount comprising divergent support rods 21 and 22 which are fastened to stem lead-in wires 7 and 8, respectively. Longer rod 21 extends in proximity to the upper wall of the bulb portion all the way to an anchoring dimple 23 at the dome end which it engages by an encircling clip 24. The upper end of the arc tube is attached to support rod 21 approximately at its midpoint by means of a hinge comprising a folded-over metal strap portion 25 spot-welded to the rod, and a stiff wire frame member 26 extending transversely to the rod through the bight or loop in the strap at the fold. Strap 25 is relatively wide and makes a hinge rigid enough to maintain the mount parts aligned when the mount assembly is folded as in FIG. 2, and when the arc tube is transversely erected as in FIG. 3. The upper pinched end of the arc tube is clamped between straps 27 which extend between the downturned ends of frame member 26. The arc tube is locked in place relative to straps 27 by reason of embossments 28 on the inner side and flaring portions 29 on the outer side. If desired, additional rigidity in the attachment may be achieved through right angle wire braces 31 which are spot welded at one end to frame member 26 and which penetrate into and engage the flaring portions 29 with their other end.

The lower end of the arc tube is pivotally attached in similar fashion to the end of short support rod 22 which in the completed lamp is welded to inlead 8. The attachment is by means of hinge strap 2, frame member 33 and clamping straps 34 which wrap around the lower pinched end, in similar fashion to the upper attachment previously described. The electrical connection to the upper electrode of the arc tube is made through fine resilient wire 35 which extends between inlead 14 and upper support rod 21. Similarly, electrical connection to the lower main electrode is through resilient wire 36 extending between inlead 15 and lower support rod 22. Inlead 18 of the auxiliary starting electrode is connected by resilient wire 37 to a current limiting resistor 38 connected to support rod 22.

Figure 2:
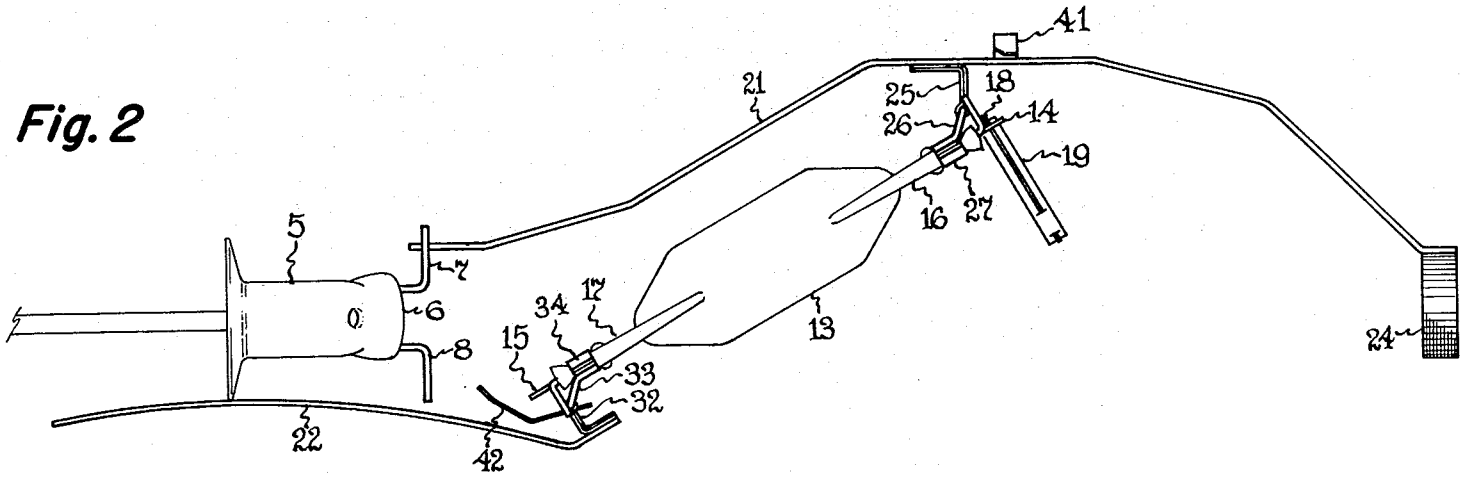
FIG. 2 shows the mount with the arc tube folded in line for passage through the neck.
Figure 3:
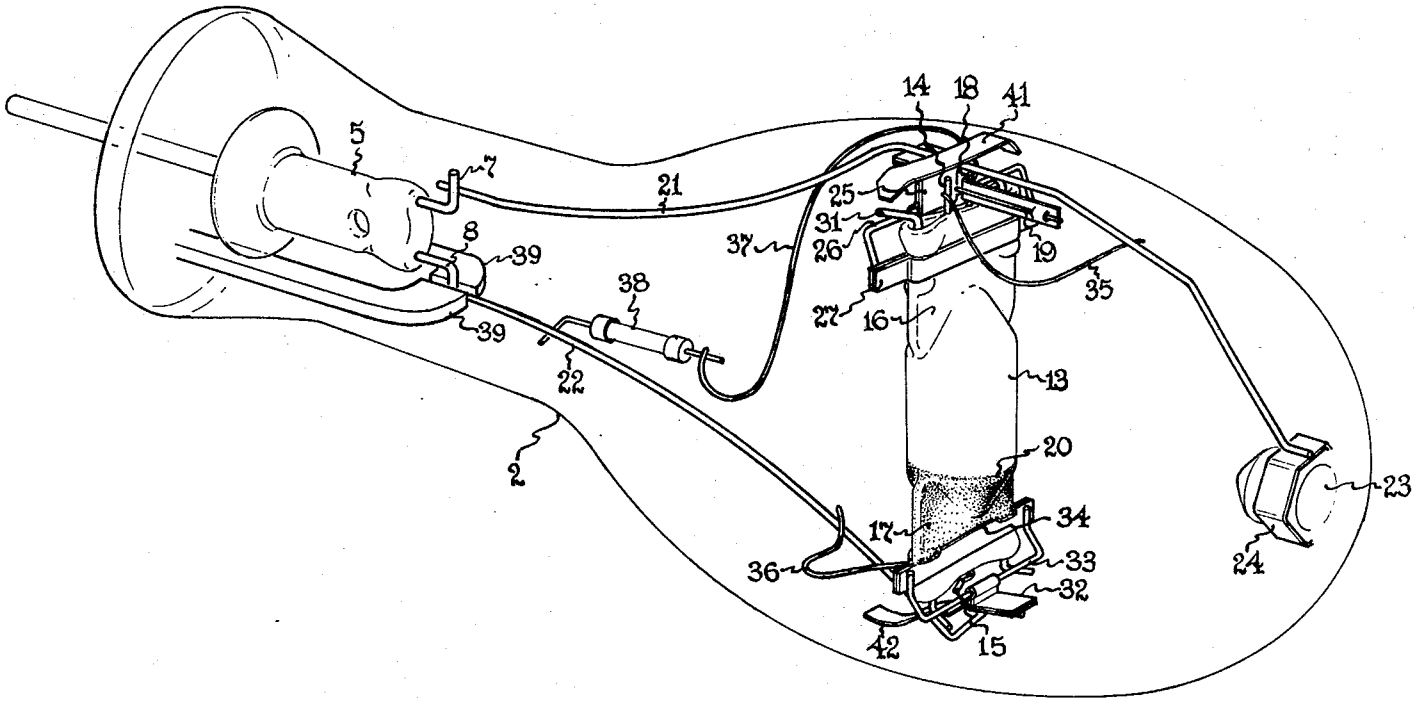
FIG. 3 shows the mount inserted into the bulb with the arc tube erected and transversely centered.

In order to insert the mount through the neck and into the bulb at manufacture, the mount assembly is completed except for the attachment of shorter support rod 22 to lead-in wire 8 of the stem. The arc tube is pivoted in line as shown in FIG. 2 so that the upper support rod 21 is leading and the lower support rod 22 is trailing. The resilient wires 35, 36 and 37 merely bend when the mount assembly is folded; for simplicity, they have not been illustrated in FIG. 2. When folded, the mount passes readily through the neck into the bulb and it is advanced until clip 24 engages anchoring dimple 23. Shorter support rod 22 is then advanced until its end is juxtaposed to lead-in wire 8: the arc tube is now transversely erected and stands vertical as shown in FIG. 3. Long needle nose pliers or an appropriate clamping device may be used to reach in through the neck beyond the stem and hold the end of support wire 22 appropriately juxtaposed to lead-in wire 8 for welding. The weld may be effected by welding electrodes 39 as shown in FIG. 3 which are inserted through the neck and overreach the stem to engage rod and lead-in wire simultaneously. After current has been passed to make the weld, the welding electrodes are withdrawn and manufacture of the lamp is completed in conventional fashion on a sealing machine followed by basing.

When current limiting resistor 38 is spot-welded to support rod 22 prior to insertion of the mount assembly into the bulb, it is necessary to make wire 37 extra long in order to permit folding the assembly for insertion. With such a long wire, there is the possibility of contact with other conductors within the bulb, particularly in applications where the lamp is subject to shock or vibration. In an alternative arrangement, a shorter wire 37 is used which is attached to resistor 38 but resistor 38 is not preattached to support rod 22. After the mount assembly has been inserted into the bulb and the arc tube transversely erected, then resistor 38 is spot-welded to rod 22 or to lead-in wire 8, using welding electrodes 39 for the purpose. This permits wire 37 to be short and extend in a substantially straight line directly from resistor 38 to inlead 18 of the starting electrode, thereby eliminating possibility of contact with other conductors.

The mount structure of our invention has a particular advantage for metal halide lamps. The arc tube filling of such lamps usually includes sodium iodide, and the sodium $Na^+$ ion can migrate through hot quartz, as is well known. Sodium loss from an arc tube has deleterious consequences, and it is encouraged by metal conductors close to the arc tube walls which can emit photoelectrons when irradiated by ultraviolet. Our construction provides no conductors close to the arc tube so that sodium loss from quartz arc tubes is not a problem.

In the preferred construction illustrated in the drawings, a transverse leaf spring 41 is attached to the upper support rod 21 at its midpoint. Another leaf spring 42 is spot welded to lower frame member 33. When the mount is folded in line as shown in FIG. 2, leaf spring 42 pivots up out of the way and does not engage the lower wall of the bulb during the insertion. After insertion when the mount is erected as shown in FIG. 3, leaf spring 42 pivots into engagement with the lower bulb wall and presses against it, at the same time causing the upper leaf spring 41 to react and press against the upper wall. This arrangement serves to centralize the arc tube in its transverse attitude and provides resiliency to the mounting structure together with greater resistance to shock. Also it prevents undesirable rattling of the arc tube and mount within the outer envelope.

What we claim as new and desire to secure by Letters Patent of the United States is:

1. An electric lamp comprising:

a glass jacket having a bulb portion with a reduced diameter neck portion closed by a stem having a pair of lead-in wires sealed therethrough, a base fastened to the end of said neck and having contact members, an elongated arc tube within the bulb portion of greater overall length than the internal diameter of the neck portion, said arc tube having electrodes attached to inleads sealed into opposite ends of the tube, and a mount structure comprising a pair of divergent support rods extending from said lead-in wires into the bulb portion, hinged attachments of the ends of the arc tube to said rods, said attachments allowing folding of the mount assembly in line with one rod leading and the other trailing for passage through the neck when only said one rod is fastened to its lead-in wire but assuring transverse erection of the arc tube within the bulb after said other rod is fastened to its lead-in wire, and flexible wire interconnections between the arc tube in-leads and said support rods.

2. A lamp as in claim 1 wherein one of said support rods is longer than the other and extends to and engages the dome end of said bulb.

3. A lamp as in claim 2 wherein said longer support rod is terminated by a clip which engages an inverted nipple in the dome end of the bulb.

4. A lamp as in claim 1 of the metal halide type wherein the arc tube is made of quartz and the filling includes sodium iodide.

5. A lamp as in claim 1 wherein spring members are attached to the mount structure next to each end of the arc tube, at least one of said spring members being pivoted into engagement with the bulb wall when the arc tube is transversely erected.

6. A lamp as in claim 1 wherein said hinged attachments each comprise a wide folded-over metal strap welded to the support rod and a stiff wire frame member extending transversely to the rod through a loop at the fold in the strap, and means fastening the end of the arc tube to the frame member.

7. A lamp as in claim 6 wherein spring members are attached to the mount structure next to each end of the arc tube, at least one of said spring members being fastened to the stiff wire frame member so as to pivot with it into engagement with the bulb wall when the arc tube is transversely erected.

8. The method of making an electric lamp of the kind comprising a glass jacket having a bulb portion with a reduced diameter neck portion closed by a stem having a pair of lead-in wires sealed therethrough, a base fastened to the end of said neck and having contact members, and an elongated arc tube transversely mounted within the bulb portion, said arc tube having electrodes attached to inleads sealed into opposite ends and being of greater overall length than the internal diameter of the neck portion, which comprises:

making a mount assembly comprising one divergent support rod extending from one of two lead-in wires sealed through a stem, making a hinged attachment of one end of the arc tube to said rod, making a hinged attachment of the other end of said arc tube to another divergent support rod, folding the mount assembly in line with said one rod leading and the other trailing, inserting said folded mount assembly through the neck into the bulb, advancing said other support rod through the neck to cause transverse erection of the arc tube within the bulb, attaching said other support rod to the other lead-in wire sealed through said stem, and then completing the manufacture of the lamp.

9. The method of claim 8 wherein said other support rod is attached to the other lead-in wire sealed through said stem by inserting welding electrodes through the neck to overreach the stem and engage support rod and lead-in wire simultaneously, and then passing current to effect a weld.

* * * * *